United States Patent [19]

Miyauchi et al.

[11] Patent Number: 4,586,809

[45] Date of Patent: May 6, 1986

[54] LIQUID DEVELOPING EQUIPMENT FOR ELECTROPHOTOGRAPHIC COPYING MACHINE

[75] Inventors: Yoshio Miyauchi; Kiyosi Takenaka; Yoshihiko Bessho, all of Hikone, Japan

[73] Assignee: Dainippon Screen Mfg. Co., Ltd., Kyoto, Japan

[21] Appl. No.: 608,438

[22] Filed: May 9, 1984

[30] Foreign Application Priority Data

May 26, 1983 [JP] Japan ..... 58-81009[U]

[51] Int. Cl.[4] ..... G03G 15/10

[52] U.S. Cl. ..... 355/10; 118/662

[58] Field of Search ..... 355/10, 4; 118/662, 118/638, 645; 430/117–119

[56] References Cited

U.S. PATENT DOCUMENTS 3,749,059 7/1973 Sato ..... 355/10 X
3,791,345 2/1974 McCutcheon ..... 118/316
4,114,999 9/1978 Kogiso et al. ..... 355/10

FOREIGN PATENT DOCUMENTS 56-14525 4/1981 Japan .
0087070 7/1981 Japan ..... 355/10
1333422 9/1970 United Kingdom .
1375688 5/1973 United Kingdom .
1482080 10/1973 United Kingdom .
1504402 1/1975 United Kingdom .

*Primary Examiner*—R. L. Moses
*Attorney, Agent, or Firm*—Brumbaugh, Graves, Donohue & Raymond

[57] ABSTRACT

A liquid developing equipment for electrophotographic copying machines to carry a photosensitive sheet to the flow of developing solution between tilted and opposing electrode plates, comprising a developing solution storage tank at the upstream of the flow channel and a developing solution discharge outlet positioned facing to the latent image surface of the photosensitive sheet.

3 Claims, 5 Drawing Figures

LIQUID DEVELOPING EQUIPMENT FOR ELECTROPHOTOGRAPHIC COPYING MACHINE

BACKGROUND AND SUMMARY OF THE INVENTION

This invention relates to a liquid developing equipment for electrophotographic copying machine. For development of electrostatic latent images formed on electrophotographic photoreceptors (hereinafter called "photosensitive sheet") using the liquid developing equipment of an electrophotographic copying machine, the following are ordinarily the indispensable conditions to obtain clear duplicated images:

(a) Even and adequate developing result is obtained on the image surface;

(b) Back side of the image surface is free from any stain by toner; and (c) The photosensitive sheet is advanced smoothly.

Different kinds of known liquid developing equipments have been proposed in order to meet the above requirements. The liquid developing equipment disclosed in Japanese Patent Application laid open under Provisional Publication No. Sho 49-62148, for example, is one of the desirable types. The structure thereof, however, is intricate and the manufacturing cost is comparatively expensive.

It is, therefore, an object of the present invention to provide a liquid developing equipment which can eliminate the above disadvantages by comparatively simple construction and of which manufacturing and maintenance are easier. According to the present invention there is provided liquid developing equipment for electrophotographic copying machines to carry a photosensitive sheet to the flow of developing solution between tilted and opposing electrode plates, comprising a developing solution storage tank at the upstream end of the said flow and a developing solution discharge outlet positioned facing to the latent image surface of the said photosensitive sheet. Other objects of the present invention will appear in the course of the following description with the accompanying drawings.

BRIEF DESCRIPTION OF DRAWINGS

In the accompanying drawings.

DETAILED DESCRIPTION OF PREFERRED EMBODIMENTS

Figure 1:
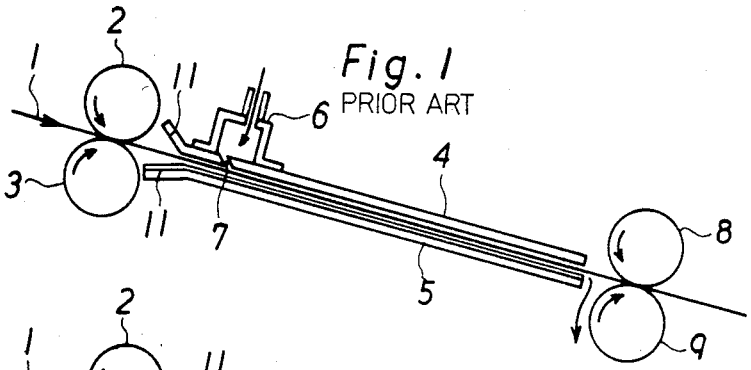
Fig. 1 PRIOR ART
FIG. 1 and FIG. 2 are sectional side views of some conventional liquid developing equipments.

The present invention is further described in comparison with prior arts and referring to the drawings. FIG. 1 is a cross sectional view of a liquid developing equipment by prior art in general (such as the Japanese Utility Model Application published under publication No. Sho 56-14525), wherein a photosensitive sheet (1) having an electrostatic latent image is transferred in the arrow direction by feed rollers (2), (3) and is passed through a tilted main electrode plate (4) and an auxiliary electrode plate (5) provided opposite to the main electrode plate. At this time, the developing solution is supplied into a solution feeder (6) by a pump (not illustrated) and is turned into evenly straighted flow through a slit-shaped discharge outlet (7) to be forcedly injected to the flow formed between the main electrode plate (4) and the auxiliary electrode plate (5).

Accordingly, the photosensitive sheet (1) is developed while passing between the opposing electrode plates (4), (5), and the electrostatic latent image is turned into a visible image. The developed photosensitive sheet (1) is sent out of the developing equipment by the squeeze rollers (8), (9), and extra developing solution is wring out by the rollers (8), (9).

Figure 2:
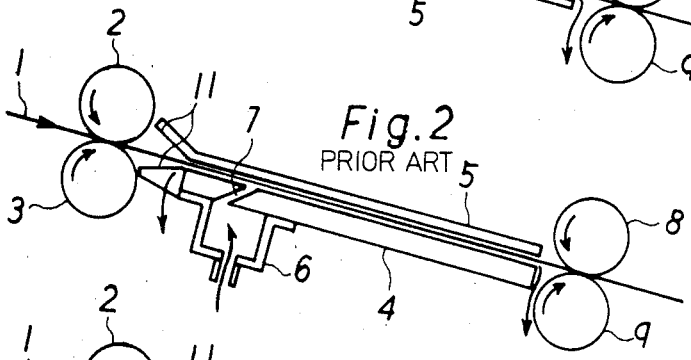
Fig. 2 PRIOR ART

The above developing equipment is one of the most popular types, and if the electrostatic latent image is positioned at the upper side, FIG. 1 is applicable and if the image is at the lower side, FIG. 2 is applicable.

Referring to the conditions described at the outset, the following are generally known as the conditions to obtain clear duplicated copies:

(a) To obtain even and adequate developing result, the spacing among the main electrode plate (4), the photosensitive sheet (1), and the auxiliary electrode plate (5) shall be even and the spacing between the opposing electrode plates (4), (5) shall be adequate.

(b) To prevent the back side from being stained by toner and to avoid disordered electric charge on the photosensitive sheet, the back side of the photosensitive sheet shall not be put in contact with the auxiliary electrode plate (5).

(c) A guide of low friction resistance is necessary to ensure smooth advance of the photosensitive sheet.

A number of attempts have been made to meet the above requirements (a), (b) and (c) at a time. By the liquid developing equipment disclosed in Japanese Patent Application laid open under Provisional Publication No. Sho 49-62148, for example, developing solution is applied to both sides of the photosensitive sheet (1), a nylon thread having larger electric resistance than that of the developing solution is stretched facing to the auxiliary electrode plate (5), and the photosensitive sheet (1) is positioned using the nylon thread as the guide so as to meet the above requirements (a), (b) and (c). The disadvantages thereof, however, are that the structure is intricated and the manufacturing cost is comparatively expensive. As another example, the one disclosed in the Japanese Utility Model Application published under Publication No. Sho 56-14525 has an electro-conductive mesh stretched opposite to the auxiliary electrode plate (5) as a guide and also for positioning. By testing, however, the effect of said electro-conductive mesh is found to have some disadvantages. One is that the polarization charge (+) on the back of the photosensitive sheet (1) is lost by the electroconductivity of the mesh and the charge (−) on the corresponding latent image surface is reduced, which lowers toner deposition by Coulomb's force making it impossible to obtain adequate developing result. Another disadvantage is that back side stain can not be prevented even by using a fine mesh of about #300 for example. Still other disadvantage is that toner sticks onto the mesh during repeated use and the sticking toner can hardly be removed when dried. Particularly at the first copying of each day, the back side is stained by partial unevenness of image density and by physical contact. If an adequate developing solution is not passed between the photosensitive sheet (1) and the auxiliary electrode plate (5), in particular, these disadvantages are outstanding.

Figure 3:
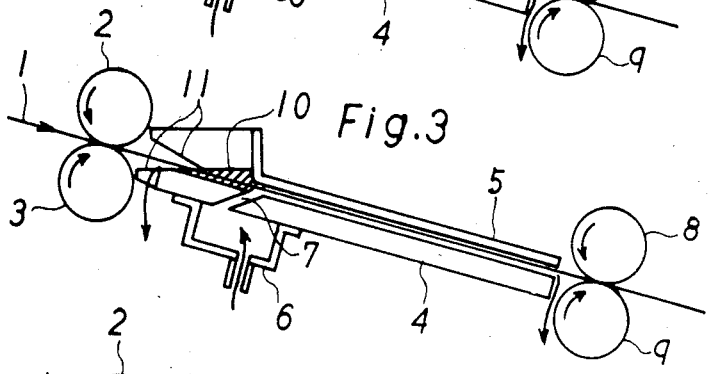
FIG. 3 is a sectional side view of the liquid developing equipment according to the present invention.
Figure 5:
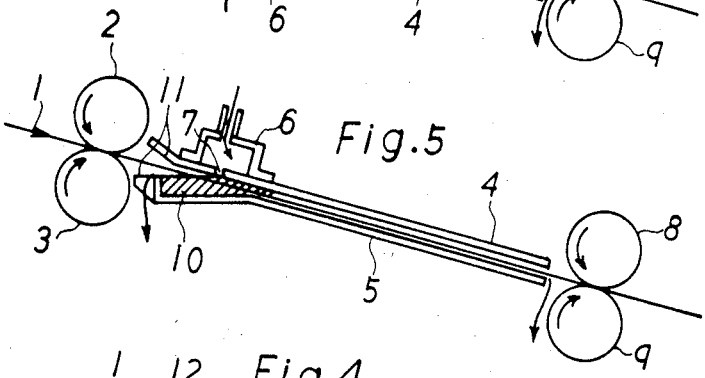
FIG. 5 is a sectional view of another embodiment in which the latent image surface is at the upper side.

FIG. 3 is a sectional view of the liquid developing equipment by the present invention. In FIG. 1 or FIG. 2 and in FIG. 3, the components of the same function are designated by the same reference numerals. The apparent difference between the present invention and prior art is in a solution tank (10) placed at the upstream of the developing solution flow channel formed by the tilted and opposing electrode plates (4), (5).

As for the operation and action of the equipment by the present invention, the developing solution is supplied to the solution feeder (6) by a pump (not illustrated) prior to feeding of the photosensitive sheet (1), then is passed through the slit shaped discharge outlet (7) crossing the said flow channel so as to be injected forcedly into said channel in even and straighted flow. After filling the flow channel by forced flow, the solution is stored in the solution tank (10) at the upstream. Then the photosensitive sheet (1) is transferred in the arrow direction by the feed rollers (2), (3) while keeping the latent image surface downward, i.e. facing to the main electrode plate (4). By the guide (11), the top of said photosensitive sheet (1) is first sent into the solution tank (10) then to the said flow channel.

Figure 4:
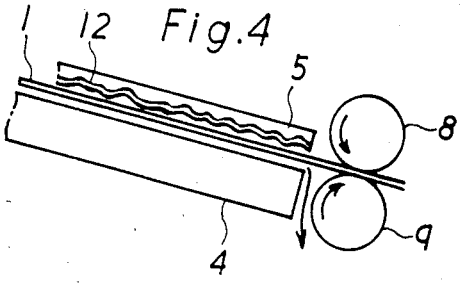
FIG. 4 is a sectional view to show the surface of the auxiliary electrode plate (5) shown in FIG. 3.

At this time, the said photosensitive sheet (1) is pushed up to the side of the auxiliary electrode plate (5) by the developing solution ejected from said discharge outlet (7) and is carried along said auxiliary electrode plate (5) as illustrated in FIG. 4.

The developing solution in the solution tank (10) flows down naturally between the back side of the photosensitive sheet (1) and the grained surface (12) formed on the auxiliary electrode plate (5) to be consumed almost completely. The developing solution naturally flowing down at this time has an effect of liquid bearing which reduces the friction resistance between said grained surface (12) and the back side of the photosensitive sheet (1) to almost zero and promotes smooth advance of said photosensitive sheet. Capacity of said solution tank (10) should be large enough, at least, to contain or store the developing solution consumed by a sheet of photoreceptor (1).

On the other hand, the developing solution flowing down from the upstream and downstream of the developing equipment is recovered into a tray (not illustrated) and is sent into the developing solution feeder (6) by a circulation pump (not illustrated). The flow quantity of the developing solution discharged from the developing solution feeder (6) connected to the circulation pump is enough to fill said flow channel and also to fill said solution tank rather quickly.

The latent image on the photosensitive sheet (1) is turned into visible image in said flow channel by the toner in the developing solution injected forcefully, then is sent out of the developing equipment by the squeeze rollers (8), (9).

The surface of the auxiliary electrode plate (5) is formed (by sand blasting, for example) into a grained shape of low contact point density (at the contact with back side of the photosensitive sheet (1)), and is covered with a resin of fluorine series of smooth sliding (generally called Teflon), which is an electric resistance material free from charging or electrification. The photosensitive sheet (1) is transferred along the grained surface (12) for smooth advancing and the back side is free from any stain.

Comprising the developing solution tank (10) at the upstream of the flow channel formed between the tilted and opposing electrode plates (4), (5) and of the slit shaped solution discharge outlet (7) positioned facing to the latent image surface of the photosensitive sheet (1), as described above, this invention has the effect of liquid bearing for smooth transfer besides the effect of the said grained surface (12) between the auxiliary electrode plate (5) and the photosensitive sheet at natural flow-down of the developing solution. It is also acceptable to use a nylon material as employed by prior art in place of the grained surface (12). Thus, compared with the prior art in which the developing solution is forced to go through both sides of the photosensitive sheet (1), the construction is simpler and manufacturing and maintenance are easier.

While a preferred embodiment has been described, variations thereto will occur to those skilled in the art within the scope of the present inventive concepts which are delineated by the following claims.

What is claimed is:

1. Apparatus for inclusion in a copying machine for developing an electrostatic latent image present on the format surface of a photosensitive sheet by a liquid toner developing solution flowing along a flow channel between a pair of opposed tilted plates comprising a developing solution storage tank at the upstream end of the flow channel for flowing the developing solution along the back surface of the sheet and a developing solution discharge outlet positioned at the upstream end of the flow channel facing the format surface of the sheet for flowing developing solution along the format surface of said sheet.

2. Apparatus as set forth in claim 1 further comprising a developing solution feeder of sufficient capability essentially to fill said flow channel with developing solution supplied from said discharge outlet and also to fill the storage tank.

3. Apparatus according to claim 1 or 2 in which the capacity of said solution storage tank is sufficient to supply the developing solution used by at least one photosensitive sheet when the solution in the tank flows naturally along the back surface of said sheet to be consumed.

* * * * *